US009938114B2

(12) United States Patent
Tuschhoff et al.

(10) Patent No.: US 9,938,114 B2
(45) Date of Patent: Apr. 10, 2018

(54) METHOD AND DEVICE FOR WINDING A METAL STRIP

(71) Applicant: SMS Group GmbH, Duesseldorf (DE)

(72) Inventors: Matthias Tuschhoff, Siegen (DE); Peter Sudau, Hilchenbach (DE); Olaf Norman Jepsen, Siegen (DE)

(73) Assignee: SMS GROUP GMBH, Duesseldorf (DE)

( * ) Notice: Subject to any disclaimer, the term of this patent is extended or adjusted under 35 U.S.C. 154(b) by 379 days.

(21) Appl. No.: 14/653,903

(22) PCT Filed: Dec. 4, 2013

(86) PCT No.: PCT/EP2013/075523
§ 371 (c)(1),
(2) Date: Jun. 19, 2015

(87) PCT Pub. No.: WO2014/095371
PCT Pub. Date: Jun. 26, 2014

(65) Prior Publication Data

US 2015/0344261 A1 Dec. 3, 2015

(30) Foreign Application Priority Data

Dec. 21, 2012 (DE) ..... 10 2012 224 351

(51) Int. Cl.
*B65H 51/30* (2006.01)
*B21C 47/00* (2006.01)
*B21C 47/34* (2006.01)

(52) U.S. Cl.
CPC ..... *B65H 51/30* (2013.01); *B21C 47/003* (2013.01); *B21C 47/345* (2013.01)

(58) Field of Classification Search
CPC ..... B65H 51/30; B65H 2220/01
USPC ..... 242/413
See application file for complete search history.

(56) References Cited

U.S. PATENT DOCUMENTS 2,521,691 A * 9/1950 Corlett ..... B65H 23/1886 101/181
3,674,221 A * 7/1972 Riemersma ..... B65H 23/1888 242/412.2
3,692,251 A * 9/1972 Melead ..... B65H 19/00 242/418.1
4,119,256 A 10/1978 Vogtmann
4,360,137 A * 11/1982 Noe ..... B21C 49/00 226/118.2

(Continued)

FOREIGN PATENT DOCUMENTS

JP 5648350 5/1981

*Primary Examiner* — Michael E Gallion
(74) *Attorney, Agent, or Firm* — Abelman, Frayne & Schwab

(57) ABSTRACT

The invention relates to a method for winding a metal strip (1) into a reel with a winding mandrel (2), to which the metal strip (1) is routed through a pair consisting of a first and a second driver roller (5, 6), at least one of which is driven. The method is characterized in that a difference between the strip speed ($V_B$) of the metal strip (1) and the speed) (v5, v6) of the driver rollers is adjusted on the basis of measuring, from measurable process variables, the strip speed and the speed (v5, v6) of at least one of the driver rollers (5, 6).

5 Claims, 4 Drawing Sheets

(56) References Cited

Figure 1:
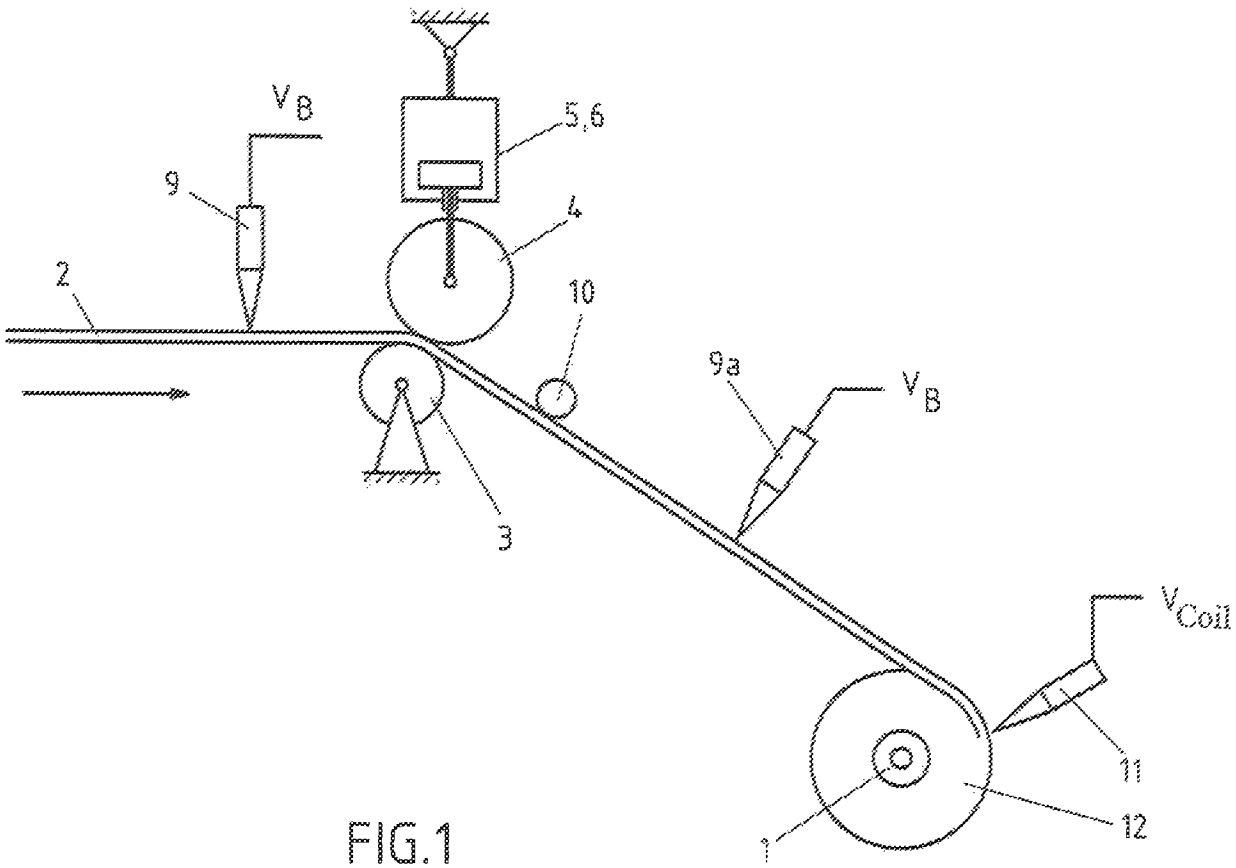

U.S. PATENT DOCUMENTS 4,729,520 A * 3/1988 Kataoka ..... B65H 23/1888 226/24
4,759,485 A * 7/1988 Braun ..... B21C 47/34 226/176
5,791,541 A * 8/1998 Jitsuishi ..... B65H 23/16 226/118.2
6,070,472 A * 6/2000 Kipping ..... B21B 37/28 72/11.7
6,192,765 B1 * 2/2001 Kipping ..... B21B 38/02 73/862.55
6,301,946 B1 * 10/2001 Kukizaki ..... B21C 47/003 72/10.2
6,378,346 B1 * 4/2002 Sudau ..... B21B 37/54 72/11.4
7,059,161 B2 * 6/2006 Armenat ..... B21B 38/02 72/11.7
8,353,190 B2 * 1/2013 Hackenberg ..... B21B 38/02 72/12.3
8,713,979 B2 * 5/2014 Schmid ..... B21C 47/003 72/10.2
2001/0013561 A1 * 8/2001 Wild ..... B65H 23/042 242/418.1
2002/0046588 A1 * 4/2002 Clark ..... B21B 37/54 72/148
2004/0211857 A1 * 10/2004 Watanabe ..... B65H 18/10 242/413
2007/0261456 A1 * 11/2007 Jepsen ..... B21B 37/24 72/227
2008/0271508 A1 * 11/2008 Kruger ..... B21B 37/28 72/12.3
2009/0139350 A1 * 6/2009 Kipping ..... B21B 38/06 73/862.451
2009/0314873 A1 * 12/2009 Schmid ..... B21C 47/003 242/534
2010/0025514 A1 * 2/2010 Kipping ..... B21C 47/003 242/418
2010/0252223 A1 * 10/2010 Franz ..... B21B 1/463 164/131
2011/0138870 A1 * 6/2011 Rose ..... B21C 47/063 72/200
2012/0279267 A1 * 11/2012 Tuschhoff ..... B21B 37/68 72/14.4
2013/0119182 A1 * 5/2013 Higeta ..... B65H 20/24 242/538.1
2015/0314982 A1 * 11/2015 Barea ..... B65H 59/388 242/419.1
2015/0344261 A1 * 12/2015 Tuschhoff ..... B21C 47/003 242/544

* cited by examiner

METHOD AND DEVICE FOR WINDING A METAL STRIP

The invention relates to a method of winding a metal strip onto a reel having a winding mandrel to which the metal strip is routed by a pair consisting of first and second driver rollers at least one of which is driven.

DE-0S 26 14 254 discloses a method of controlling strip tension causing contact pressure in a driver apparatus for a rolled strip, in particular, before a strip downcoiler in a wide strip rolling mill in which two driver rollers are set to a gap spacing corresponding to a respective strip thickness, and are loaded with a predetermined constant holding force in a direction against each other.

This document also discloses a driver apparatus for a rolled strip, in particular, for arrangement before the strip downcoiler in a wide strip rolling mill and which is formed of two driver rollers which are brought, for pre-setting to different strip thicknesses, to a gap spacing relative to each other by lifting spindle gears and which are set, for setting the roller contact pressure, by pressure medium cylinders under a holding pressure against each other, wherein one of the rollers is supported in a bearing housing and is associated with the pressure medium cylinder, on the other hand. The roller contact pressure is maintained only so large that it is sufficient for retaining the frictional connection between the rolled strip and the roller, taking into account safety factors. The roller contact pressure should be so regulated, dependent on respective strip thickness and strip width, that a specific strip tension is reduced with increase of the strip thickness.

WO 2008/037395 discloses a method and an apparatus for winding up metal strips onto a winding mandrel which is arranged in a reel shaft and to which the metal strip is passed by a driver having a lower and an upper driver roller, wherein a table is provided underneath the metal strip for guidance, and a pivotable strip diverter and, adjoining the latter almost up to the winding mandrel, a pivotable shaft flap are arranged above the metal strip.

A strip tension measuring device that immerses into the metal strip from above, determines the longitudinal tensile force applied to the metal strip by the driver, and the measured signal is communicated to a driver regulating device for controlling displacement of the strip by the driver.

With swinging, according to the invention, of the strip tension measuring device from above toward the metal strip, in particular, an optimal winding angle can also be retained at the strip end. The tensile measurement of the metal strip in the reel shaft should insure such regulation of the driver that it so influences the strip displacement that a strip coil with straight edges is formed.

WO 2008/09289 discloses an operating method for a reeling apparatus for winding and unwinding a metal strip as well as a control device and the reeling apparatus. The reel can be associated with a driving roller. A control device is associated with the reel.

In order to prevent an excessive tension of the strip that can be so high that it would exceed the yield point of the strip, i.e., would lead to plastic changes of the strip shape, e.g., strip neckings, an actual characteristic of the strip, an actual strip temperature and/or an actual microstructural characteristic is measured or determined by model calculation and is used as an actual variable. The control device determines, based on the actual variable or a derived therefrom value, an actual torque value acting in or opposite direction of the strip displacement, and drives the reel and/or the driver roller, using the actual torque value. The torque value can be used as a set torque value or as a torque value threshold. For calculation of the torque value threshold, the actual stiffness of the to-be-wound strip is used. This stiffness is decisively influenced by the strip temperature and/or its microstructure. By actually using the torque calculation based on the actual values of the parameters which determine the strip stiffness over the entire winding process, a uniform winding torque and a better winding quality are obtained.

The object of the invention is a new method of winding a metal strip.

According to the invention, this object is achieved, in a method described in the above-mentioned prior art, in that a difference between the strip speed of the metal strip and the speed of the driver rollers is adjusted based on measurement of the strip speed and the speed of at least one of the driver rollers from measurable process variables.

Either the total force that acts on the metal strip in a gap between the two rollers, or the drive torques of the driver rollers drives are so controlled that they are reliably transferred to the metal strip, whereby small or controlled speed differences between the surfaces of the driver rollers and the metal strip are achieved.

To this end, either the predetermined set forces on both sides are so changed by a controller, dependent on the measured speed of the driver rollers (force correction) that a desired speed difference between the surfaces of driver rollers, on one hand, and the metal strip, on the other hand, is achieved, or the drive torques of the driven driver rollers are so changed (torque correction) that the speed difference, with respect to the metal strip, for each of the drives for driver rollers is achieved.

Further modifications of the invention follow from the sub-claims, description, and drawings.

Advantageously, a controller so controls the difference between the strip speed of the metal strip and the speed of at least one of the driver rollers that the difference between the strip speed and a surface speed of the driver rollers does not exceed an adjustable threshold.

According to an advantageous embodiment of the method, the drives of the driver rollers and the mandrel are controlled by controlling contact forces of the driver rollers applied to the strip, and the set rotational speeds of the drives are so predetermined that a predetermined relative speed between the driver rollers is maintained, and the set value of the contact force of the driver rollers is so controlled that a predetermined tension in the metal strip takes effect in a region between the driver rollers and coil wound on the mandrel.

It is particular advantageous when a drive contact force or a drive torque of the at least one driven roller is so predetermined that the difference between the strip speed and the surface speed of the at least one driven roller does not exceed an adjustable threshold. Preferably, the rotational speed of the mandrel is also controlled.

According to a further advantageous embodiment of the invention, the drive torque of the mandrel is so predetermined that the difference between the strip speed and the surface speed of the at least one of the driver rollers does not exceed an adjustable threshold.

Advantageously, the strip speed is measured a contactless manner or by a speed measuring roller that applies pressure to the metal strip. Alternatively, the strip speed is determined by measuring the rotational speed of the mandrel and a diameter of strip windings wound on the mandrel.

Advantageously, the diameter of the coil wound on the mandrel can also be measured.

In an advantageous embodiment of the method, a non-linear interrelationship between the strip speed, the speed of the driver rollers and a force applied by the driver rollers to the metal strip is predetermined.

Advantageously, the force, the force generator, applies to the driver rollers, is controlled. It is also possible to predetermine additional force correction values for controlling the force applied to the driver rollers.

According to a further advantageous embodiment of the method, a proportional integral controller determines correction of the contact force of the driver rollers based on a difference between a set value and the actual value for the tension in the metal strip in the region between the driver rollers and the coil wound on the mandrel.

Particularly advantageous is a method according to which a three-point controller determines a timely correction of the contact force of the driver rollers based on the difference between the set value and the actual value of the tension in the metal strip between the driver rollers and the coil.

The invention also relates to a device for winding a metal strip into a coil for carrying the above described method.

Figure 2:
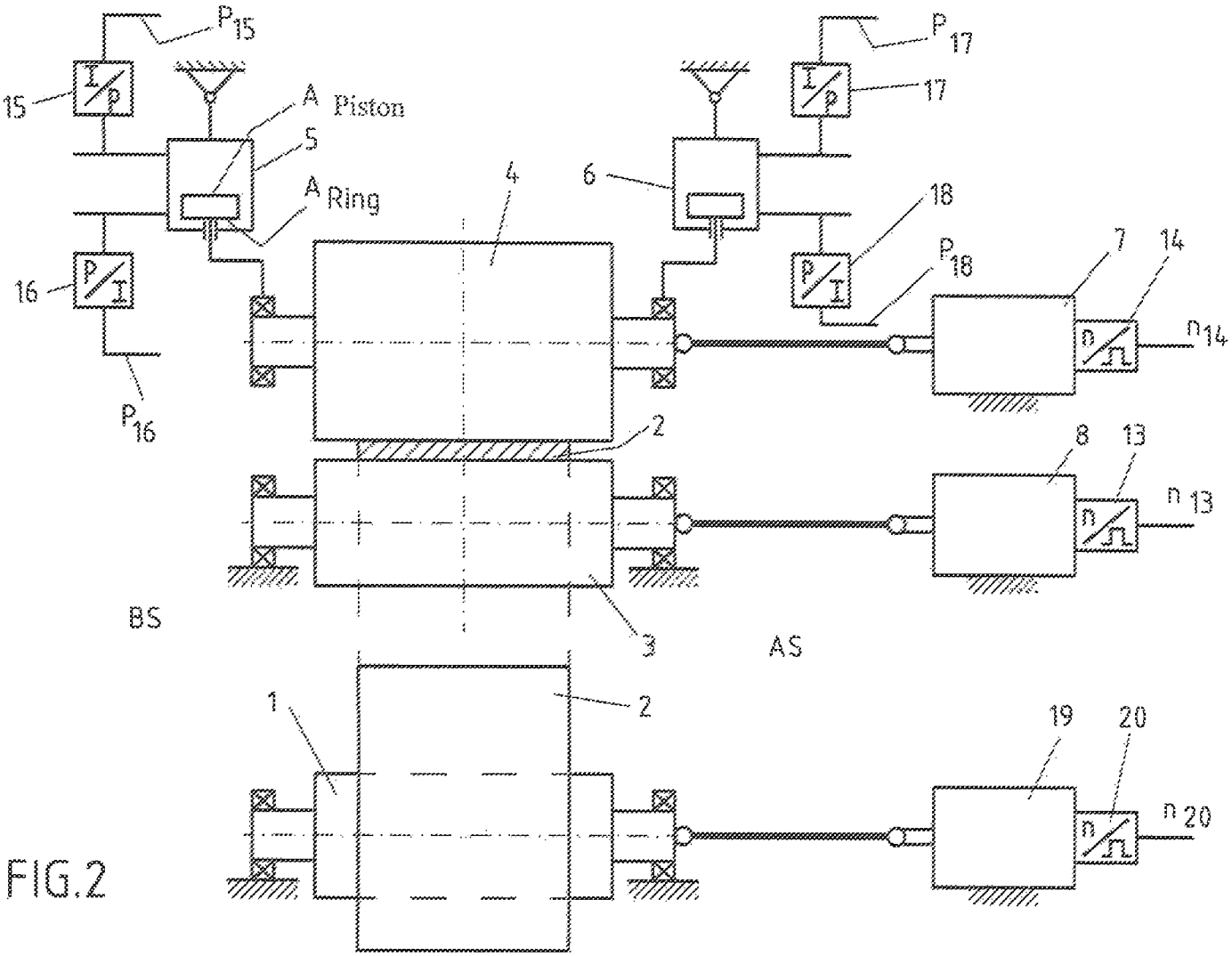
Figure 3:
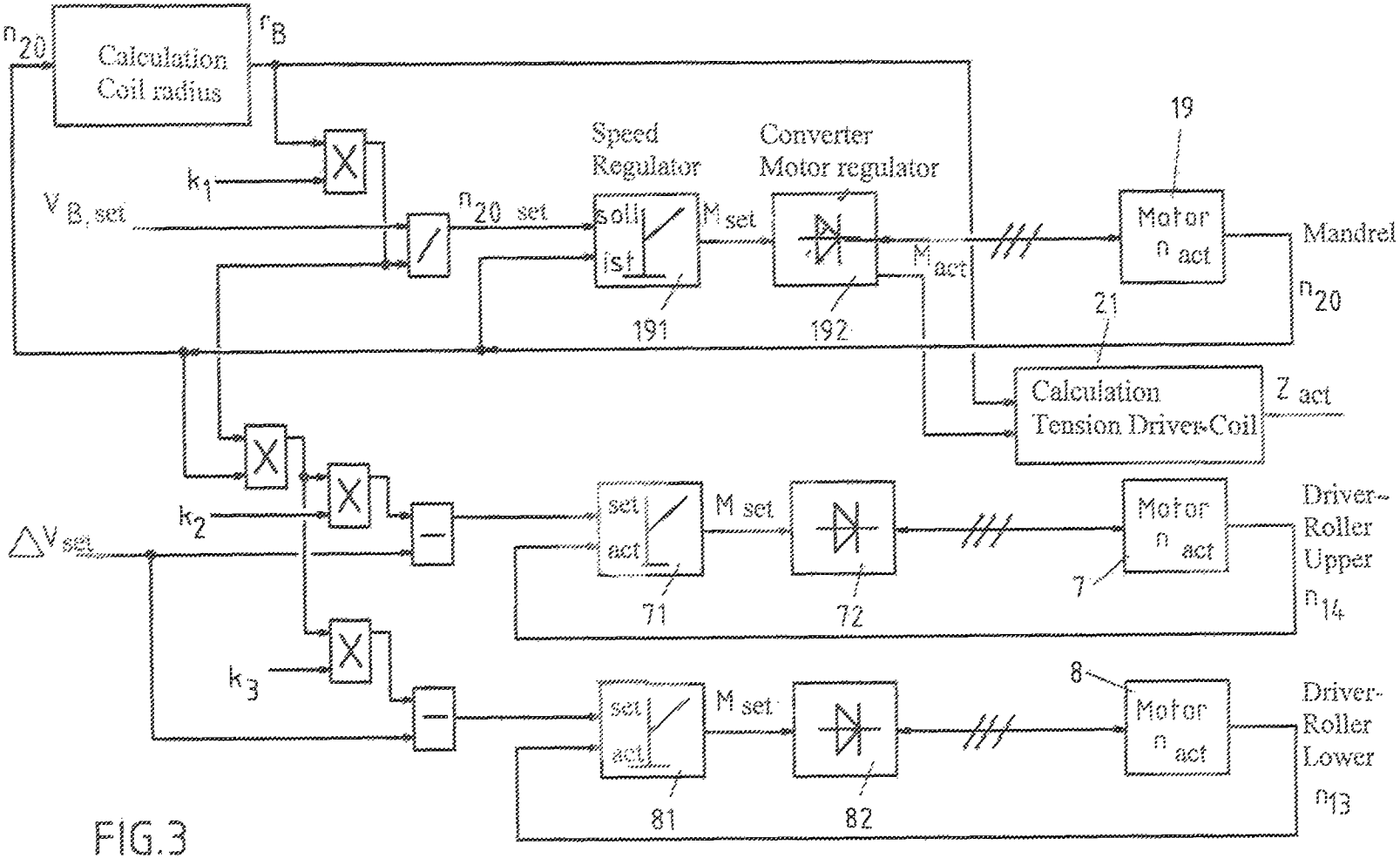
Figure 4:
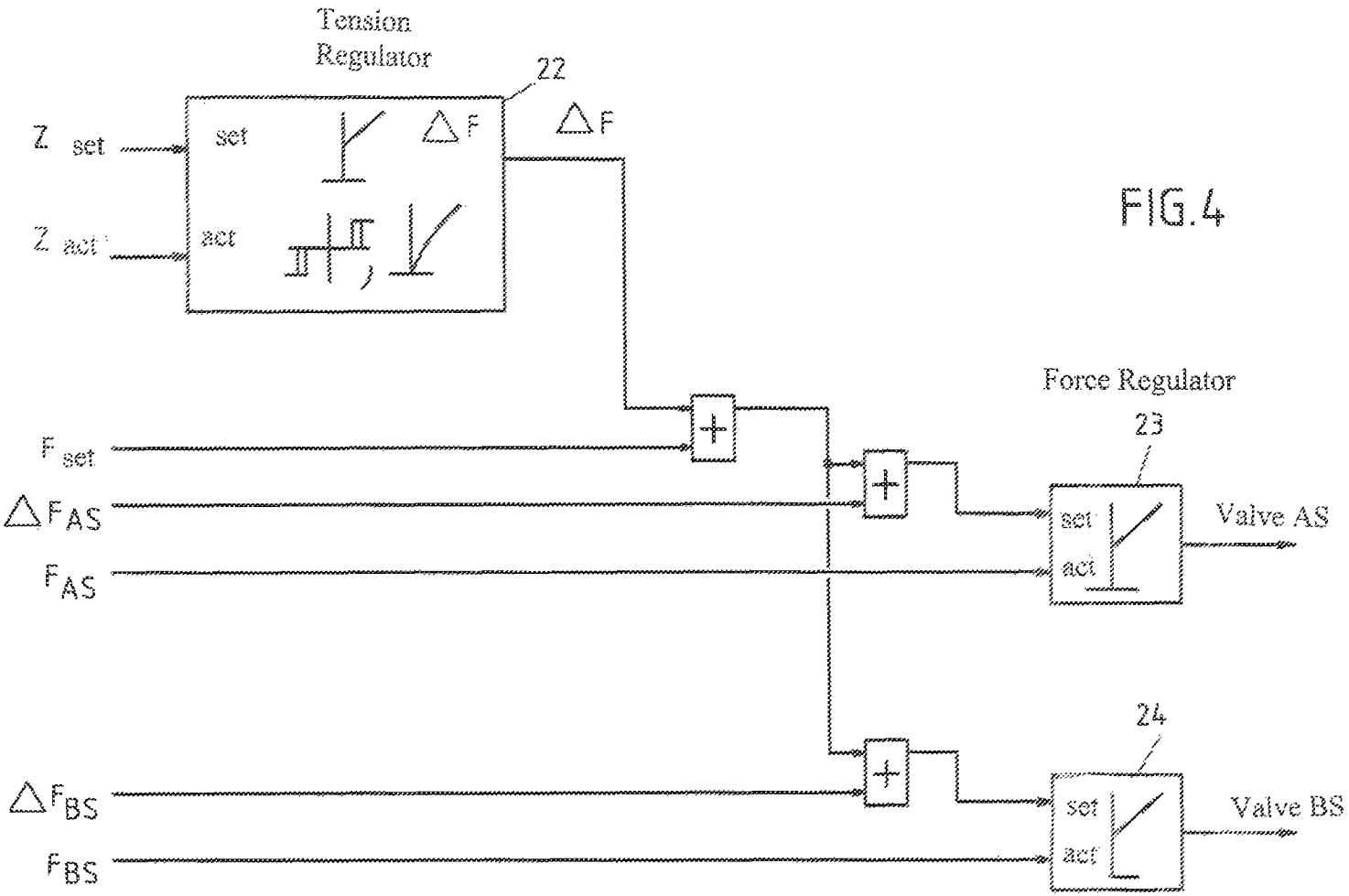

Below, an exemplary embodiment will be described in detail. The drawings show:

FIG. 1 a schematic side view of a winding device for winding a metal strip on a mandrel with a driver having two driver rollers;

FIG. 2 a schematic plan view of the driver rollers and the mandrel together with respective drives;

FIG. 3 a control diagram for calculation of speeds of the driver rollers and the mandrel; and FIG. 4 tension control and the control diagram of the contact forces of the driver rollers.

A winding device (FIG. 1) serves for winding a metal strip 2 that is wound to a coil 12 of the metal strip 2. The metal strip 2 reaches the winding device on a horizontal roller table where it is deflected to the mandrel 1 by two driver rollers 3, 4 which are leaning against the metal strip 2 and against each other, and is wound there in a coil 12.

The driver rollers 3, 4 provide the metal strip 2 with the necessary tension. The driver rollers 3, 4 and the mandrel 1 are driven, respectively, by a motor 7, 8 or 19, directly or, alternatively, via a gear set. In one embodiment of the invention, only one of the driver rollers 3, 4 is driven, whereas another driver roller 3, 4 is carried along. Preferably, the torques of the driver rollers 3, 4 or the mandrel 1 are regulated. The rotational speeds of the motors 8 and 19 (FIG. 2) are measured by rotational speed sensors 13, 14 or 20.

The motors 7, 8, 19 are operated with a speed regulation. For each drive, a rotational speed regulator 71, 81, 191 (FIG. 3) determines a torque set value dependent on a set rotational speed, an actual rotational speed, and time-dependent run of both signals, which is communicated to an associated converter 72, 82, or 192 that regulates the motor current. The converters 72, 82, 192 provide a present (momentary) value of the torque. In the drawings, the converters 72, 82, 192 are shown with thyristor symbols because the converters 72, 82, 192 can include switching means that, preferably, have a thyristor.

The object of the process consists in driving the driver rollers 3, 4 with a lower speed than the strip speed $V_B$ that is predetermined by the drive of the mandrel 1, so that a predetermined relative speed between the driver rollers 3, 4 and the strip 2 is obtained. To this end, the circumferential speeds $V_u$,$V_o$ of the driver rollers 3, 4 and the coil 12, which are calculated taking into account the motor rotational speeds $K_1$, $K_2$, $K_3$, possible gear ratios, drive characteristics such as slip, friction, etc., and diameters of the driver rollers 3, 4, and the radius of the coil, are considered. The coil radius can be calculated based on the changing and metrologically determined diameter of the mandrel which is determined based on the number of windings which are counted during the winding process, and the strip thickness. Alternatively, it is also possible to directly measure the coil radius with a distance measuring apparatus 11.

The strip speed $V_B$ can also be measured with a contactless sensor 9, 9*a* that can be arranged between the driver rollers 3, 4 and the mandrel 1 or in front of the driver rollers 3, 4. It is also possible to use a contact measuring roller 10 insertable between the driver rollers 3, 4 on one hand, and the coil 12, on the other hand, for measuring the strip speed $V_B$.

A high-level control system (FIG. 3) provides set values for the strip speed $V_B$ set and the relative speed $V_A$ set between the driver rollers 3, 4, on one hand, and the strip 2, on the other hand.

A force generating device for pressing the driver rollers 3, 4 against the metal strip 2 can, as shown, by the way of example, with respect to the driver roller 4 in FIG. 1, be formed as hydraulic cylinders 5, 6. The hydraulic cylinders 5, 6 act on the journals of the driver roller 4 on both sides, adjacent to the drive side AS and on opposite side, operational side BS. The force actual values are determined from measurement of acting in hydraulic cylinders, pressures 15, 16 or 17, 18, wherein the pressures from 15 to 18 are determined from measurement values obtained on the annular surface A ring or on the piston side surface A piston, as shown in FIG. 2 with respect to the hydraulic cylinder 5.

The forces on both sides are regulated independent from each other. The set forces are determined from a basic value Fset, possible correction values $\Delta F_{AS}$, $\Delta F_{BS}$, of controllers or other regulation systems, and a force correction for providing a predetermined tension.

In order to determine the force correction necessary for obtaining a desired strip tension, firstly, an actual value for the tension Zact in the strip 2 in the region between the driver rollers 3, 4 and the coil 12 is calculated by a calculator unit 21, taking into consideration possible operational factors, momentary coil radius, friction losses, effect of acceleration, and deformation stress of the strip material at bending around the mandrel.

The force correction $\Delta F$ for the contact force of the driver rollers 3, 4 is determined, based on the difference between the predetermined set value $Z_{set}$ for the strip tension and the calculated actual value $Z_{act}$ as well as its time-dependent run, by, e.g., a proportional integral controller 22 (FIG. 4), and is communicated, together with the set value of the force, to an adder the output value of which on both sides, the drive side AS and the operational side BS, is combined by a further adder with correction values $\Delta F_{AS}$, $\Delta F_{BS}$, and is communicated to the respective force regulator 23, 24 as force set value. Those are obtained from comparison of the actual force values $F_{AS}$, $F_{BS}$ which are obtained from measured pressures, with force set values for the values of the force generating devices in form of the hydraulic cylinders 5, 6 on the drive and operational sides. The controllers can be formed as three-point controllers for timely changes of the force correction.

The circumferential speed $V_o$ of the upper roller 4 is obtained from the diameter $d_4$ of the roller 4 and the rotational speed signal N14 of the drive of this roller measured in revolution/min from an equation:

$$vo=\pi n_{14}d_4/60;$$

and for the lower roller 3 having a diameter $d_3$ and rotational speed $\eta_{13}$, from an equation:

$$v_u = \pi n_{13} d_{13}/60.$$

The circumferential speed $V_B$ of the coil 12 with a changing coil radius $\pi_B$ and the rotational speed of the driver and which is measured in revolution/min, is determined from an equation:

$$V_B = \pi n_{12} r_B/30.$$

The coil radius an be calculated from the mandrel diameter $d_D$, the number of windings $n_w$, and the strip thickness h as follows:

$$r_B = \tfrac{1}{2} d_D + nwh.$$

The actual values $F_{AS}$ and $F_{BS}$ in the cylinders can be calculated based on the measured pressures and the hydraulic operational surfaces on the piston side and the annular side of the respective piston. For the drive side AS, this value is:

$$F_{AS} = A_{piston} P_{17} - A_{ring} P_{18};$$

for the operational side BS, this value is $$F_{BS} = A_{piston} P_{15} - A_{ring} P_{16}.$$

LIST OF REFERENCE NUMERALS

1 Mandrel
2 Strip
3 Lower driver roller
4 Upper driver roller
5 Force generating device on the drive side
6 Force generating device on the operational side
7 Upper roller drive
8 Lower roller drive
9 Sensor for sensing the strip speed
9*a* Sensor for sensing the strip speed
10 Speed measuring roller
11 Sensor for sensing the coil diameter
12 Coil
13 Tachometer of the lower roller
14 Tachometer of the upper roller
15 Pressure sensor of cylinder 5, piston side pressure
16 Pressure sensor of cylinder 5, ring side pressure
17 Pressure sensor of cylinder 5, piston side pressure
18 Pressure sensor of cylinder 5, ring side pressure
19 Mandrel drive
20 Mandrel rotational speed sensor
21 Calculator unit for calculation of the actual traction between the driver and the coil
22 Controller of strip tension between the driver and the coil
23 Force controller
71 Force controller
72 Rotational speed controller
81 Rotational speed controller
82 Converter
191 Rotational speed controller
192 Converter

The invention claimed is:

1. A method of winding a metal strip (2) on a reel having a mandrel to which the metal strip (2) is routed by a pair of first and second driver rollers (3, 4) of which at least one is driven, wherein a difference between a strip speed ($V_B$) of the metal strip (2) and a speed of the driver rollers is adjusted based on measurement of the strip speed and the speed (Vu, Vo) of at least one of the driver rollers (3, 4) from measurable process variables, wherein a controller (22) so controls the difference between the strip speed ($V_B$) of the metal strip (2) and the speed of at least one of the driver rollers (3, 4) that the difference between the strip speed ($V_B$) and a surface or circumferential speed ($V_u$, $V_o$) of the driver rollers (3, 4) does not exceed an adjustable threshold, characterized in that a drive torque of the at least one driver roller (3,4) is so predetermined that the difference between the strip speed ($V_B$) and the surface speed ($V_u$, $V_o$) of the at least one driver roller (3, 4) does not exceed the adjustable threshold, in that drives of the driver rollers (3, 4) and the mandrel (1) are controlled by controlling a contact force of the driver rollers (3, 4) applied to the strip (2), and the set rotational speeds of the drives are so predetermined that a predetermined relative speed (AVset) between the driver rollers (3, 4) is maintained, and in that the set value of the contact force of the driver rollers (3, 4) is so controlled that a predetermined tension in the metal strip (2) takes effect in a region between the driver rollers (3, 4) and a coil wound on the mandrel (1).

2. A method according to claim 1, characterized in that a contact force of at least one driver roller (3,4) applied to the strip (2) is so predetermined that the difference between the strip speed ($V_B$) and the surface speed ($V_u$, $V_o$) of the at least one driver roller (3, 4) does not exceed the adjustable threshold.

3. A method according to claim 1, characterized in that a rotational speed of the mandrel is controlled.

4. A method according to claim 1, characterized in that a drive torque of the mandrel (1) is so predetermined that the difference between the strip speed ($V_B$) and the surface speed ($V_u$, $V_o$) of the at least one of the driver rollers (3, 4) does not exceed the adjustable threshold.

5. A method according to claim 1, characterized in that the strip speed ($V_B$) is measured in a contactless manner by sensors (9, 9*a*) or by a speed measuring roller (10) that applies pressure to the metal strip (2), or that the strip speed ($V_B$) is determined by measuring a rotational speed of the mandrel (1) and a diameter of strip windings wound on the mandrel (1) or the coil (12).

* * * * *